United States Patent [19]

Enga

[11] 4,299,192

[45] Nov. 10, 1981

[54] CATALYTIC COMBUSTION

[75] Inventor: Bernard E. Enga, Maidenhead, England

[73] Assignee: Johnson, Matthey & Co., Limited, London, England

[21] Appl. No.: 35,298

[22] Filed: May 2, 1979

[30] Foreign Application Priority Data

May 8, 1978 [GB] United Kingdom ..... 18242/78

[51] Int. Cl.[3] ..... B09B 3/00

[52] U.S. Cl. ..... 122/4 D

[58] Field of Search ..... 122/4 D, 37; 431/7, 431/170; 110/234; 252/437

[56] References Cited

U.S. PATENT DOCUMENTS

| | | | |
|---|---|---|---|
| 2,878,789 | 3/1959 | Huet | 122/4 D |
| 2,997,031 | 8/1961 | Ulmer | 122/4 D |
| 3,048,153 | 8/1962 | Abrahamsen | 122/4 D |
| 3,119,378 | 1/1964 | Marshall | 122/4 D |
| 3,870,455 | 3/1975 | Hindin | 431/7 |
| 4,021,185 | 5/1977 | Hindin et al. | 431/7 |

*Primary Examiner*—Edward G. Favors

*Attorney, Agent, or Firm*—Cushman, Darby & Cushman

[57] ABSTRACT

A boiler suitable for catalytic combustion of fuel comprises a pilot burner and at least two sections comprising a fuel injector, a catalytic combustor and a heat exchanger. The catalytic combustor may comprise a monolith support for the catalyst. Combustion of the fuel takes place in stages with intermediate abstraction of heat, combustion being completed in the final catalytic combustor in which the oxygen content preferably is reduced substantially to zero.

13 Claims, 2 Drawing Figures

Figures 1, 2:
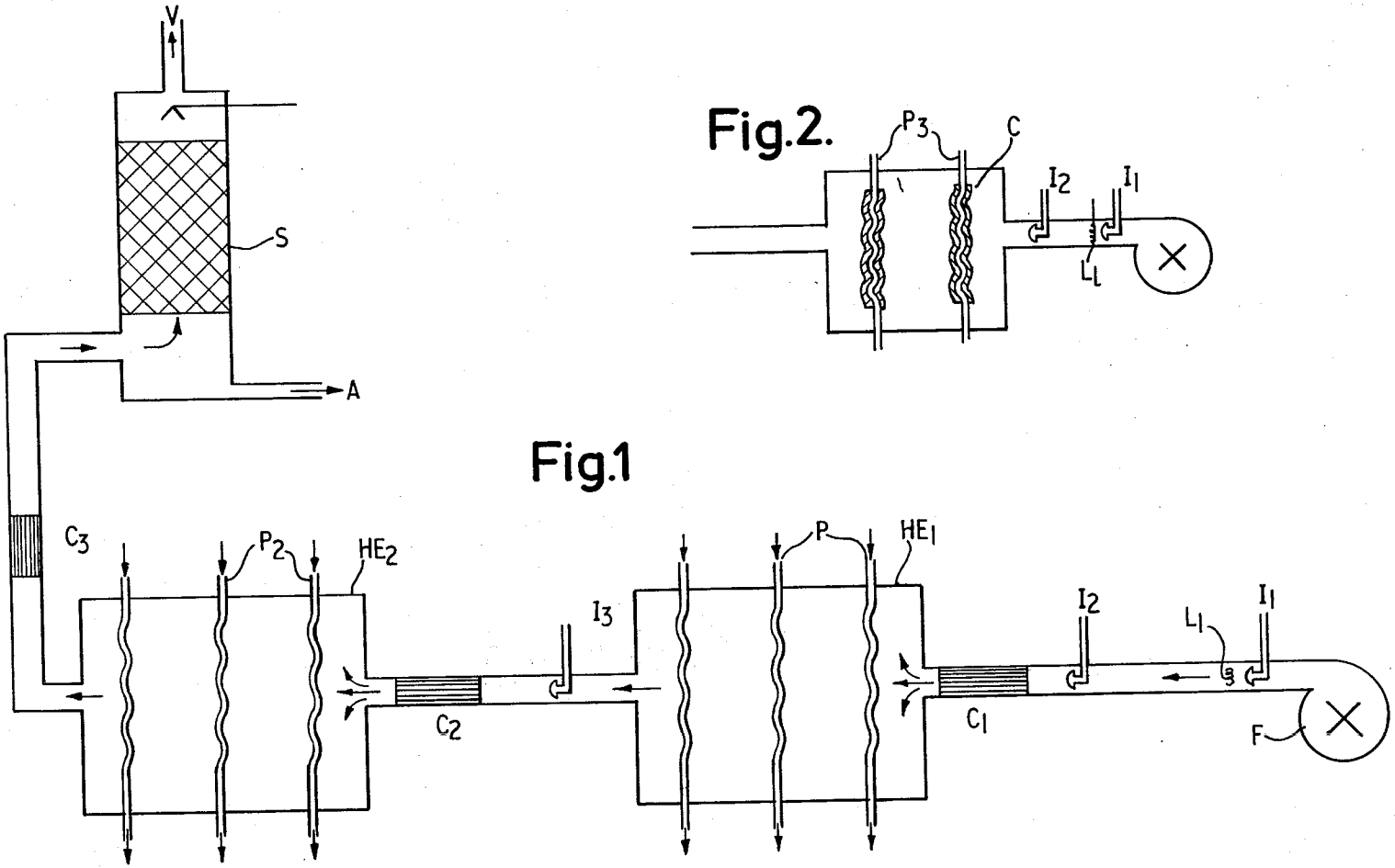

C
P3
I1
I2
L1
F
g
C1
HE1
P
I3
C2
HE2
P2
C3
S
V
A

CATALYTIC COMBUSTION

This invention relates to boilers and to improved methods of operation of boilers in which catalytic combustion of the fuel takes place.

At present it is unusual for a boiler to utilize catalytic combustion. The main difficulty confronting designers is the high temperatures produced when all the fuel is burnt with excess oxygen present. Existing supports and catalysts are unable to withstand these temperatures which are about 2400° K.

Further, in conventional boilers part of the heat generated by burning fuel is transferred to heat exchangers by radiation. The section of a conventional boiler required to trap the radiated heat, which section is large compared to a section required to remove heat from the combusted gases by contact with a heat exchanger, is not required by a boiler utilizing catalytic combustion.

According to the present invention in the operation of a boiler a major proportion of the fuel undergoes catalytic combustion within the confines of a boiler in at least two stages with intermediate abstraction of heat after each stage.

In this way the temperatures in each stage can be reduced to one which catalysts and the supports therefor can withstand. Suitable temperature ranges in each stage are from 600° to 1250° C. depending on the particular catalyst and support. An advantage of operating in this temperature range is that it is below the fixation temperature of nitrogen and consequently the combusted gases are free of nitrogen oxides. Additionally, catalysed combustion results in lower uncombusted fuel content. A further advantage of catalysed combustion is that it is possible to operate with minimum of air for combustion, i.e. excess oxygen in the combusted gases can be reduced almost to zero.

A boiler, according to the present invention, comprises:

(a) a fan to provide an input of air for combustion of the fuel, (b) a pilot burner fuelled by a fuel injector (c) an injector for injecting a further proportion of the fuel into the stream of hot gases from the preceding combustion (d) a catalytic combustor section where catalytic combustion of a substantial proportion of the uncombusted fuel is initiated (e) further parts (c) and (d) repeated at least once and using the remainder of the fuel and optionally (f) an oxidation catalyst followed by a scrubber and precipitation unit to remove sulphur dioxide and particulates from the fuel gases.

The pilot burner, which is of a conventional type, burns a minor proportion of the total fuel consumed during normal running. This minor proportion depends on the fuel used. In the case of propane it is suitably about 10% and in the case of natural gas is suitably about 25%. Preferably the input air is preheated by the pilot burner to a temperature of at least 100° C. The fuel injector for the pilot burner is able to control the quantity of fuel injected and is adjusted primarily to give a temperature within a specified preferred range in the combustion chamber of 200° C. to 500° C.

There are numerous arrangements of the combustion chamber and catalysts of which three are outlined below by way of example.

In one possible arrangement the catalyst is positioned between a fuel injector and a heat exchanger. The catalyst is supported on a ceramic or metallic monolith. Water pipes which pass through the heat exchanger chamber abstract heat produced in this stage of combustion of the fuel. More fuel is injected into the flow of gases and this arrangement and the stage of combustion, is repeated at least once and in this way all the fuel and oxygen are used up. Most of the combustion of the injected fuel takes place on the catalyst and heat so generated is abstracted in the following heat exchanger. In the first stage, combustion initiated on the catalyst may carry over to a minor degree beyond the catalytic combustor section, but preferably this is reduced to a minimum and, in the final catalytic stage, is reduced to zero, combustion being completed on the catalyst. At this final stage of the combustion, the oxygen content of the gases is also reduced as near as possible to zero.

In a second possible arrangement a proportion of the fuel is injected into preheated air before a combined combustion and heat exchanger chamber. In this arrangement the catalyst is present as a coating on the water pipes passing through the chamber and combustion takes place on the catalyst coating. To enable the pipes to withstand the high temperatures and oxidising conditions they are first coated with an aluminium containing composition of the type described in U.S. application Ser. No. 876,565 filed Feb. 10, 1978, now U.S. Pat. No. 4,196,099.

In a third possible arrangement the combustion chamber is in the form of a long cylinder, surrounded by a water jacket. The cataylst is sited inside the chamber optionally in a monolith or as a pellets packed into the chamber.

The first exemplifying arrangement is illustrated in the drawing accompanying the provisional specification.

In FIG. 1 F is a fan providing an input of air to pilot burner comprising igniter $L_1$ and injector $I_1$ for injecting a minor proportion of the fuel. Injector $I_2$ injects a further proportion of the fuel into hot stream of gases. $C_1$ is a catalytic combustor and $HE_1$ is the first heat exchanger containing pipes P which contain flowing water of fluid coolant for removing heat. Further combustion of a further proportion of fuel injected by injector $I_3$ takes place in catalytic combustion unit $C_2$ and further heat is abstracted in heat exchanger $HE_2$ by fluid passing through pipes $P_2$.

Combustor $C_3$ oxidises $SO_2$ to $SO_3$ and this is recovered as sulphuric acid A by scrubber S leading from which is vent V leading to a precipitator for removal of particulates.

FIG. 2 shows a combustion stage in a further embodiment of the invention in which heat exchanger pipes $P_3$ are coated with catalyst on which combustion takes place, thus obviating the need for separate catalytic combustor section.

The catalyst may be supported on a monolith, and preferably a washcoat is applied to the monolith before it is coated with the catalyst. The washcoat could be a high surface area, refractory metal oxide such as beryllia, magnesia or silica or combinations of metal oxides such as boria-alumina or silica-alumina.

If the monolith is metallic the walls preferably have a thickness within the range 50–100 microns. The preferred characteristics of the metallic monolith having a catalyst deposited thereon are (i) that is presents low resistance to the passage of gases by virtue of its possession of a high ratio of open area to blocked area and (ii) that it has a high surface to volume ratio.

Preferably the metallic monolith is formed from one or more metals selected from the group comprising Ru, Rh, Pd, Ir and Pt. However, base metals may be used or base metal alloys which also contain a platinum group metal component may be used.

Suitable platinum group metals for use in fabrication of the metallic monolith are platinum, 10% rhodium platinum and dispersion strengthened platinum group metals and alloys as described in British Patent Specifications Nos. 1280815 and 1348876 and U.S. Pat. Nos. 3,689,987, 3,696,502 and 3,709,667.

Suitable base metals which may be used are those capable of withstanding rigorous oxidising conditions. Examples of such base metal alloys are nickel and chromium alloys having an aggregate Ni plus Cr content greater than 20% by weight and alloys of iron including at least one of the elements chromium (3–40) wt. %, aluminium (1–10) wt.%, cobalt (0–5) wt.%, nickel (0–72) wt.% and carbon (0–0.5) wt.%. Such substrates are described in German OLS No. 2450669. A particularly suitable alloy is one containing 0.09 wt.% carbon, 22.6 wt.% chromium, 2 wt.% cobalt, 4.5 wt.% aluminium and balance iron.

Other examples of base metal alloys capable of withstanding the rigorous conditions are iron-aluminium-chromium alloy which may also contain yttrium. The latter may contain 0.5–12 wt.% Al, 0.1–3.0 wt.% Y, 0–20 wt.% Cr and balance Fe. These are described in U.S. Pat. No. 3,298,826. Another range of Fe-Cr-Al-Y alloys contain 0.5–4 wt.% Al, 0.5–3.0 wt.% Y, 20.0–95.0 wt.% Cr and balance Fe and these are described in U.S. Pat. No. 3,027,252.

Base metal alloys which also contain a platinum group metal component are useful as a catalytic metallic monolith in very fierce oxidising conditions, for example in catalysis of the combustion in gas turbine engines. Such alloys are described in German DOS No. 2530245 and contain at least 40 wt.% Ni or at least 40 wt.% Co, a trace to 30 wt.% Cr and a trace to 15 wt.% of one or more of the metals Pt, Pd, Rh, Ir Os and Ru. The alloys may also contain from a trace to the percentage specified of any one or more of the following elements:

| | % by weight |
|---|---|
| Co | 25 |
| Ti | 6 |
| Al | 7 |
| W | 20 |
| Mo | 20 |
| Hf | 2 |
| Mn | 2 |
| Si | 1.5 |
| V | 2.0 |
| Nb | 5 |
| B | 0.15 |
| C | 0.05 |
| Ta | 10 |
| Zr | 3 |
| Fe | 20 |
| Th and rare earth metals or oxides | 3 |

Where the metallic substrate is composed either substantially or solely of platinum group metal it may be in the form of an interwoven wire gauze or mesh or corrugated sheet or foil. Where the metallic substrate is composed substantially of base metal it is preferably in the form of corrugated sheet or foil. These types of base metal monoliths are also described in German OLS No. 2450664 and they may be used in boilers according to the present invention. Such base metal monoliths may have deposited thereon a first layer comprising an oxygen containing coating and a second and catalytic layer. The oxygen containing coating is usually present as an oxide selected from the group consisting of alumina, silica, titania, zirconia, hafnia, thoria, beryllia, magnesia, calcium oxide, strontium oxide, barium oxide, chromia, boria, scandium oxide, yttrium oxide and oxides of the lanthanides. Alternatively, the oxygen in the first layer is present as an oxygen containing anion selected from the group consisting of chromate, phosphate, silicate and nitrate. The second catalytic layer may, for example, comprise a metal selected from the group consisting of Ru, Pd, Ir, Pt, Au, Ag, an alloy containing at least one of the said metals and alloys containing at least one of the said metals and a base metal. The first and second layers may be deposited or otherwise applied to the monolith as described in German OLS No. 2450664.

Alternative catalytic monoliths are the structures defined in British Patent Application No. 51219/76 dated Dec. 8, 1976.

In British Patent Application No. 51219/76 there is described a catalyst comprising a metallic substrate having deposited thereon a surface coating consisting of one or more intermetallic compounds of the general formula $A_xB_y$ where A is selected from the group consisting of Al, Sc, Y, the lanthanides, Ti, Zr, Hf, V, Nb and Ta and x and y are integral and may have values of 1 or more.

In British Patent Application No. 51219/76 the surface coating of intermetallic compound is, preferably, in the form of a thin film ranging in thickness from 2 to 15 microns.

Many compounds of the type $A_xB_y$ are miscible with one another and structures in which the surface coatings deposited upon the said metallic substrate contains more than one compound of the type $A_xB_y$ are within the scope of this invention.

When the metallic compound is deposited in the form of a coating not more than 15 microns thick upon the surface of a metallic substrate, excessive brittleness is absent and the coated substrate may be handled normally.

A number of different techniques may be employed to produce a coating in the form of a thin film of intermetallic compound upon the surface of the metallic monolith. For example, aluminium may be deposited onto the surface of rhodium-platinum gauzes by a pack-aluminising process. In this process the gauzes are packed into a heat-resistant container in an appropriate mixture of chemicals such that aluminium is transferred via the vapour phase to the gauze surface. At the aluminising temperature, typically 800–900° C., interaction between the platinum and aluminium occurs to give the required intermetallic compound.

Alternatively, chemical vapour deposition from $ZrCl_4$ can be used to form a layer of $Pt_3Zr$, or electrodeposition may be used either from aqueous or fused salt electrolysis to give the requisite compound.

Whichever method is adopted the objective is to form a layer of a firmly adherent, intermetallic compound on the wires of the gauze pack or other substrate.

In another technique, the metals forming the intermetallic compound are prepared as an appropriate solution in water or an organic solvent. The compound is caused to deposit upon the metallic substrate or gauze by the addition of a reducing agent. The metallic substrate is placed in the solution whilst the precipitation is taking place and becomes coated with a uniform, microcrystalline layer of the intermetallic compound.

Ceramic monoliths may also be used but in order to keep back pressure to a minimum, a larger cell structure, e.g. about 15,000 cells per square meter, is preferable.

I claim:

1. A boiler comprising a pilot burner, means for supplying fuel to said pilot burner, and at least two sections each comprising a fuel injector, a catalytic combustor and a heat exchanger, the catalytic combustor in both sections comprising a monolith support which is coated with a wash coat on which a combustion catalyst is deposited.

2. A boiler as claimed in claim 1 in which the monolith is metallic.

3. A boiler as claimed in claim 1 in which the monolith carries a first coating of an oxygen containing compound on which the catalyst is deposited.

4. A boiler as claimed in claim 1 in which the monolith is fabricated from a metal selected from the group consisting of Ru, Rh, Pd, Ir and Pt.

5. A boiler as claimed in claim 1 in which the monolith is fabricated from an Fe-Al-Cr alloy which may also contain Y.

6. A boiler as claimed in claim 1 in which the monolith is fabricated from an alloy containing 0.09% C, 22.6% Cr, 2% Co, 4.5 Al and balance Fe.

7. A boiler as claimed in claim 1 in which the catalyst for the combustion is supported on cooland pipes in the heat exchanger.

8. A boiler as claimed in claim 7 in which the coolant pipes carry a first coating of an aluminium-containing composition on which the catalyst is deposited.

9. A boiler as claimed in claim 1 in which the catalyst for the combustion is a metal selected from the group consisting of Ru, Pd, Ir, Pt, Au, Ag and alloys containing at least one such metal.

10. A method of operating a boiler which comprises injecting fuel into the confines of a boiler in at least two stages, providing in each stage a catalytic combustor comprising a monolith which is coated with a wash coat on which a combustion catalyst is deposited, catalytically combusting fuel in the first stage by passing a mixture of the fuel and excess oxygen over the catalytic combustor to obtain a mixture of combusted gases including oxygen, removing heat from the combusted gases in said first stage, mixing the resulting cooled gases with additional fuel, passing the resulting mixture over the catalytic combustor in a second stage, removing heat from the combusted gases in the second stage, maintaining the temperature of the catalytic combustion in both said stages at a temperature in the range of 600°–1250° C., and operating the catalytic combustors in both stages throughout the operation of the boiler.

11. A method as claimed in claim 10 in which the oxygen content of the combusted gases is reduced substantially to zero in the final stage of catalytic combustion.

12. A method as claimed in claim 10 in which, within each stage prior to the final stage, there is catalytic combustion of a substantial proportion of the fuel introduced into that section.

13. A method as claimed in claim 10 in which in the final section combustion of the fuel is substantially completed.

* * * * *